US009414656B1

(12) United States Patent
Greene

(10) Patent No.: US 9,414,656 B1
(45) Date of Patent: Aug. 16, 2016

(54) CANE WITH EXTENDABLE SPIKES

(71) Applicant: Vernon Greene, Cicero, NY (US)

(72) Inventor: Vernon Greene, Cicero, NY (US)

( * ) Notice: Subject to any disclaimer, the term of this patent is extended or adjusted under 35 U.S.C. 154(b) by 0 days.

(21) Appl. No.: 14/680,685

(22) Filed: Apr. 7, 2015

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01)

(58) Field of Classification Search
CPC ..... A45B 9/04; A61H 3/0288
USPC ..... 135/70, 78, 80, 81
See application file for complete search history.

(56) References Cited

U.S. PATENT DOCUMENTS 2,596,733 A * 5/1952 Sibner ..... A63C 11/221 135/81
2,682,275 A * 6/1954 Eyrich ..... A61H 3/0288 135/70
2,753,879 A * 7/1956 Rosen ..... A45B 3/00 135/15.1
3,183,031 A * 5/1965 Haberstick ..... E01H 1/12 294/61
3,448,749 A * 6/1969 Stark ..... A45B 9/04 135/70
3,901,258 A 8/1975 Montgomery
4,434,808 A 3/1984 Burak
4,977,914 A 12/1990 Smerker

FOREIGN PATENT DOCUMENTS

CA WO 9315626 A1 * 8/1993 ..... A45B 9/00
DE WO 2006074633 A1 * 7/2006 ..... A45B 9/04
DE 102005062044 A1 * 7/2007 ..... A45B 9/04

* cited by examiner

*Primary Examiner* — Noah Chandler Hawk
(74) *Attorney, Agent, or Firm* — Crossley and Stevenson Intellectual Property Law

(57) ABSTRACT

A cane with extendable spikes including a cane having a curved handle and a shaft, a hollow inner casing, a U-shaped outer casing, an aperture continuously disposed from a top surface of the handle to an upper area of the inner casing, an activation control, a rod, a locking mechanism, an internal tension spring, a horizontal plate, a ferrule, a plurality of openings, a plurality of spikes, and a plunger. The activation control has a depressed position and an alternate extended position. The plurality of spikes is configured to extend below a base edge of the ferrule when the activation control is in the depressed position. One of each of the plurality of spikes is configured to be fully disposed within one of each of the plurality of openings when the activation control is in the extended position.

4 Claims, 3 Drawing Sheets

CANE WITH EXTENDABLE SPIKES

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of canes are known in the prior art. However, what has been needed is a cane having a curved handle, a shaft, a hollow inner casing, a U-shaped outer casing, an aperture continuously disposed from a top surface of the handle to an internal surface of the inner casing, an activation control disposed within a top side of the aperture, a rod continuously disposed within the aperture, a locking mechanism, an internal tension spring, a horizontal plate disposed within the inner casing, a ferrule, a plurality of openings, a plurality of spikes, and a plunger. What has been further needed is for the activation control to engage the rod. Lastly, what has been needed is for the activation control to slidingly engage the spring, the locking mechanism, the rod, the plunger, the plate, and the plurality of spikes when the activation control is in a depressed position, or alternately an extended position. The plurality of spikes is configured to extend below the ferrule base edge when the activation control is in the depressed position. One of each of the plurality of spikes is configured to be fully disposed within one of each of the openings when the activation control is in the extended position. Thus, the cane with extendable spikes provides a user with optimal stability on slippery surfaces in order to prevent injuries and falls. Rather than require a user to install a separate traction device on his or her cane, the cane with extendable spikes allows a user to easily adjust the cane depending on the surface conditions.

FIELD OF THE INVENTION

The present invention relates to canes, and more particularly, to a cane with extendable spikes.

SUMMARY OF THE INVENTION

The general purpose of the present cane with extendable spikes, described subsequently in greater detail, is to provide a cane which has many novel features that result in a cane with extendable spikes which is not anticipated, rendered obvious, suggested, or even implied by prior art, either alone or in combination thereof.

To accomplish this, the present cane with extendable spikes comprises a cane having a curved handle and a shaft. The shaft has a top end and a bottom end. The handle has a top surface, a bottom surface, a right side, and a left side. A hollow inner casing is medially disposed on the bottom end of the shaft. The inner casing has a right area, a left area, an upper area, and a lower area. Each of the right area, the left area, the upper area, and the lower area has an external surface and an internal surface. A U-shaped outer casing is continuously disposed on each of the external surface of the left area, the right area, and the lower area of the inner casing. The outer casing has a right edge, a left edge, and a bottom edge. Each of the right edge, the left edge, and the bottom edge has an exterior surface.

An aperture is continuously disposed from the top surface of the handle proximal the left side to the internal surface of the upper area of the inner casing. The aperture has a top side and a bottom side. An activation control is disposed within the top side of the aperture. The activation control has a top area and a bottom area. A rod is continuously disposed within the aperture from the bottom area of the activation control to the bottom end of the shaft. The rod has an upper end, a lower end, an external area, and an internal area. The activation control engages the rod. A locking mechanism is disposed on the bottom area of the activation control. The locking mechanism is continuously disposed around the external area of the rod proximal the upper end of the rod. The locking mechanism has an upper surface and a lower surface. An internal tension spring is continuously disposed around the external area of the rod from the lower surface of the locking mechanism to the top end of the shaft. A horizontal plate is disposed within the inner casing. The plate has an upper edge and a lower edge. A plunger has a top half and a bottom half. Each of the top half and the bottom half has a top portion and a bottom portion. The top portion of the top half is disposed on the lower end of the rod. The bottom portion of the bottom half is disposed on the upper edge of the plate. The bottom half is disposed within the inner casing.

The cane with extendable spikes further comprises a ferrule having an exterior area, an interior area, and a base edge. The interior area of the ferrule is continuously disposed on the exterior surface of each of the right edge, the left edge, and the bottom edge of the outer casing. The ferrule is optionally rubberized. A plurality of openings is disposed from the internal surface of the lower area of the inner casing to the exterior area of the base edge of the ferrule. A plurality of spikes is attached to the lower edge of the plate. One of each of the plurality of spikes is continuously disposed through one of each of the plurality of openings. The plurality of spikes is optionally steel.

The activation control has a depressed position and an alternate extended position. The activation control is in the depressed position when the activation control is fully disposed within the aperture. The activation control is in the extended position when the top area of the activation control is disposed above the top side of the aperture. The activation control slidingly engages the spring, the locking mechanism, the rod, the plumber, the plate, and the plurality of spikes. The plurality of spikes is configured to extend below the base edge of the ferrule when the activation control is in the depressed position. One of each of a plurality of spikes is configured to be fully disposed within one of each of the plurality of openings when the activation control is in the extended position.

Thus has been broadly outlined the more important features of the present cane with extendable spikes so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
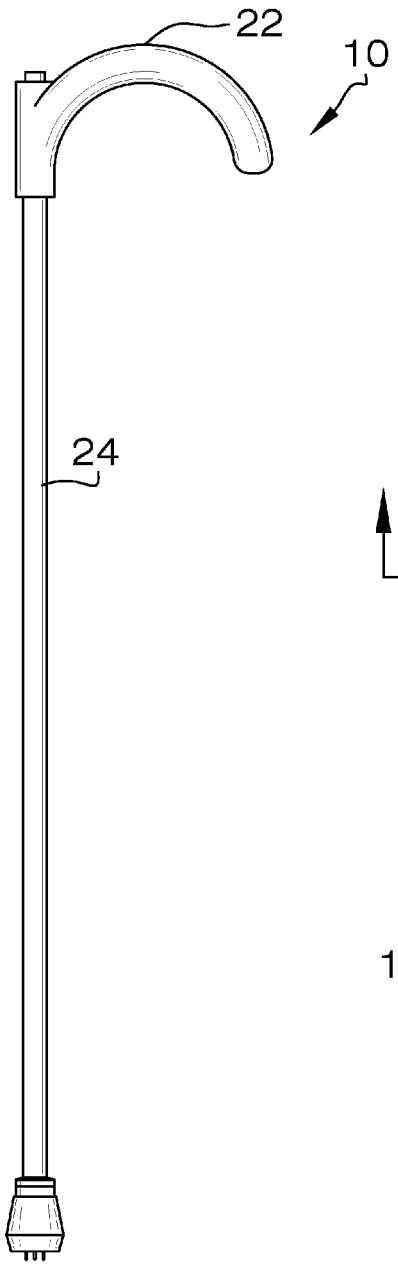
FIG. 1 is a front isometric view.
Figure 2:
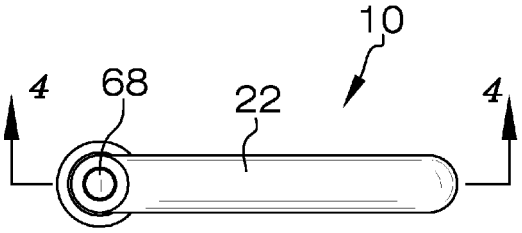
FIG. 2 is a top plan view.
Figure 3:
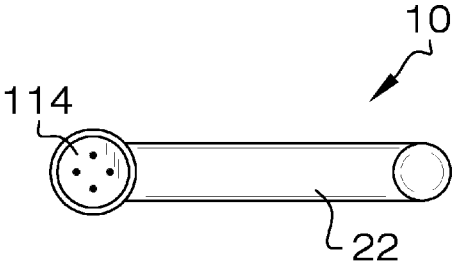
FIG. 3 is a bottom plan view.

With reference now to the drawings, and in particular FIGS. 1 through 4B thereof, an example of the instant cane with extendable spikes employing the principles and concepts of the present cane with extendable spikes and generally designated by the reference number 10 will be described.

Referring to FIGS. 1 through 4B, the present cane with extendable spikes 10 is illustrated. The cane with extendable spikes 10 comprises a cane 20 having a curved handle 22 and a shaft 24. The shaft 24 has a top end 26 and a bottom end 28. The handle 22 has a top surface 30, a bottom surface 32, a right side 34, and a left side 36. A hollow inner casing 38 is medially disposed on the bottom end 28 of the shaft 24. The inner casing 38 has a right area 40, a left area 42, an upper area 44, and a lower area 46. Each of the right area 40, the left area 42, the upper area 44, and the lower area 46 has an external surface 48 and an internal surface 50. A U-shaped outer casing 52 is continuously disposed on the external surface 48 of each of the left area 42, the right area 40, and the lower area 46 of the inner casing 38. The outer casing 52 has a right edge 54, a left edge 56, and a bottom edge 58. Each of the right edge 54, the left edge 56, and the bottom edge 58 has an exterior surface 60.

An aperture 62 is continuously disposed from the top surface 30 of the handle 22 proximal the left side 36 to the internal surface 50 of the upper area 44 of the inner casing 38. The aperture 62 has a top side 64 and a bottom side 66. An activation control 68 is disposed within the top side 64 of the aperture 62. The activation control 68 has a top area 70 and a bottom area 72. A rod 74 is continuously disposed within the aperture 62 from the bottom area 72 of the activation control 68 to the bottom end 28 of the shaft 24. The rod 74 has an upper end 76, a lower end 78, an external area 80, and an internal area 82. The activation control 68 engages the rod 74. A locking mechanism 84 is disposed on the bottom area 72 of the activation control 68. The locking mechanism 84 is continuously disposed around the external area 80 of the rod proximal the upper end 76 of the rod 74. The locking mechanism 84 has an upper surface 86 and a lower surface 88. An internal tension spring 90 is continuously disposed around the external area 80 of the rod 74 from the lower surface 88 of the locking mechanism 84 to the top end 26 of the shaft 24. A horizontal plate 92 is disposed within the inner casing 38. The plate 92 has an upper edge 94 and a lower edge 96. A plunger 98 has a top half 100 and a bottom half 102. Each of the top half 100 and the bottom half 102 has a top portion 104 and a bottom portion 106. The top portion 104 of the top half 100 is disposed on the lower end 78 of the rod 74. The bottom portion 106 of the bottom half 102 is disposed on the upper edge 94 of the plate 92. The bottom half 102 is disposed within the inner casing 38.

The cane with extendable spikes further comprises a ferrule 108 having an exterior area 110, an interior area 112, and a base edge 114. The interior area 112 of the ferrule is continuously disposed on the exterior surface of each of the right edge 54, the left edge 56, and the bottom edge 58 of the outer casing 52. A plurality of openings 116 is disposed from the internal surface 50 of the lower area 46 of the inner casing 38 to the exterior area 110 on the base edge 114 of the ferrule 108. A plurality of spikes 118 is attached to the lower edge 96 of the plate 92. One of each of the plurality of spikes 118 is continuously disposed through one of each of the plurality of openings 116.

Figure 4A:
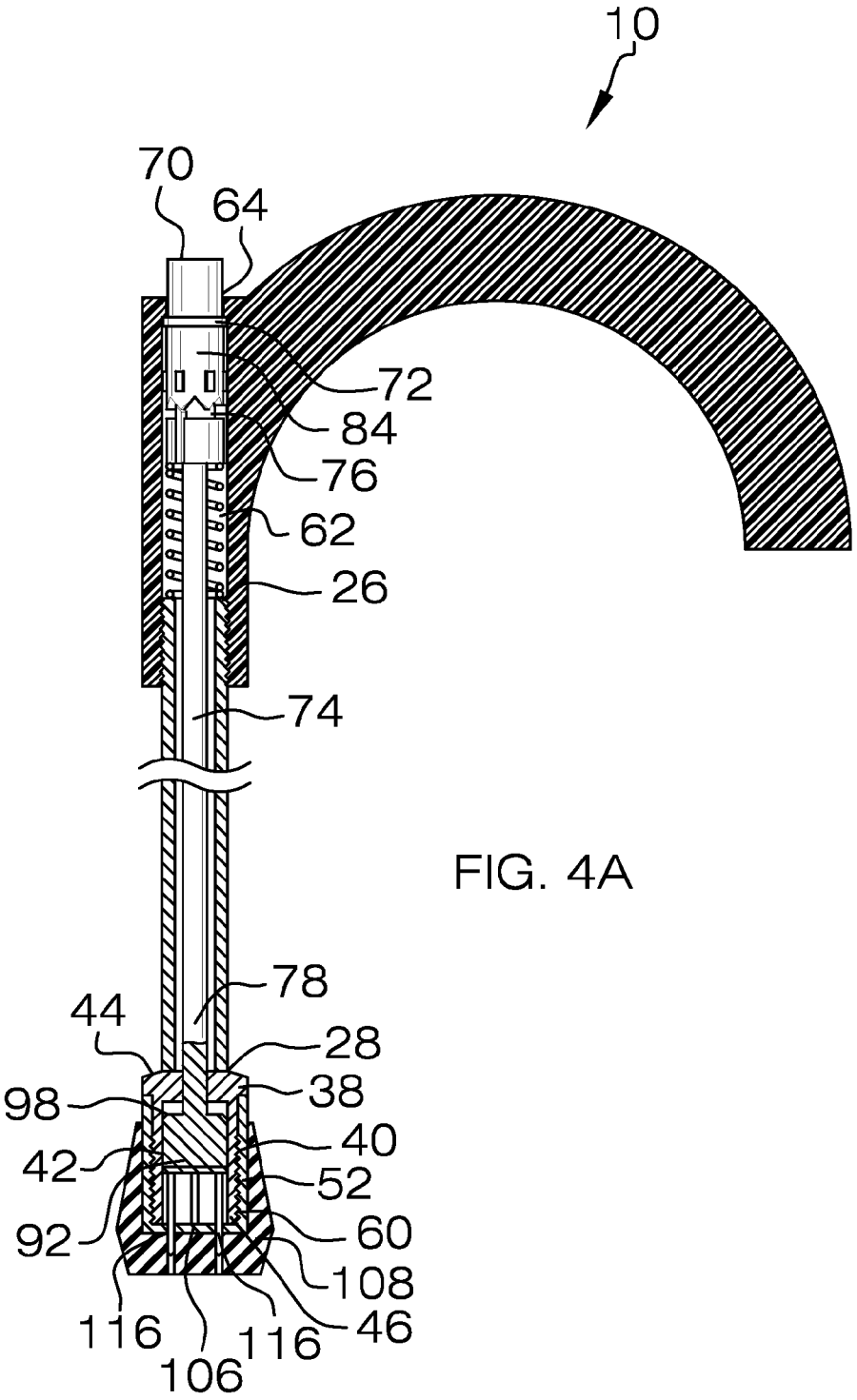
FIG. 4A is a cross-sectional view taken along line 4-4 of FIG. 2 showing the activation control in an extended position.
Figure 4B:
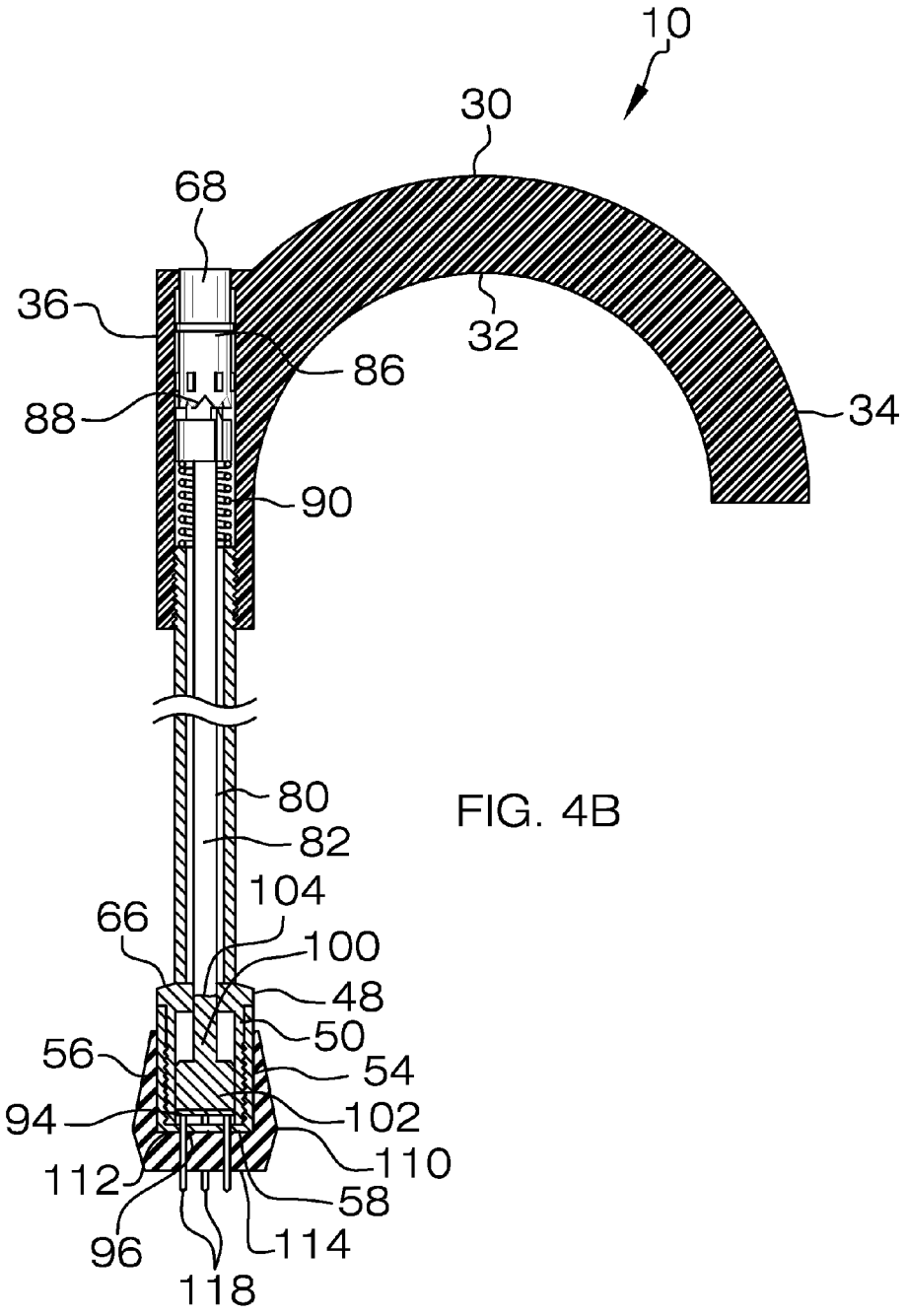
FIG. 4B is a cross-sectional view taken along line 4-4 of FIG. 2 showing the activation control in a depressed position.

As best shown in FIGS. 4A and 4B, the activation control 68 has a depressed position and an alternate extended position.

What is claimed is:

1. A cane with extendable spikes comprising:

a cane having a curved handle and a shaft, the shaft having a top end and a bottom end, the handle having a top surface, a bottom surface, a right side, and a left side;

a hollow inner casing medially disposed on the shaft bottom end, the inner casing having a right area, a left area, an upper area, and a lower area, each of the right area, the left area, the upper area, and the lower area having an external surface and an internal surface;

a U-shaped outer casing continuously disposed on each of the external surface of the left area, the right area, and the lower area of the inner casing, the outer casing having a right edge, a left edge, and a bottom edge, each of the right edge, the left edge, and the bottom edge having an exterior surface;

an aperture continuously disposed from the top surface of the handle proximal the left side to the upper area internal surface of the inner casing, the aperture having a top side and a bottom side;

an activation control disposed within the aperture top side, the activation control having a top area and a bottom area;

a rod having an upper end, a lower end, an external area, and an internal area, the rod continuously disposed within the aperture from the activation control bottom area to the shaft bottom end, wherein the activation control engages the rod;

a locking mechanism disposed on the activation control bottom area, the locking mechanism continuously disposed around the rod external area proximal the upper end, the locking mechanism having an upper surface and a lower surface;

an internal tension spring continuously disposed around the rod external area from the locking mechanism lower surface to the shaft top end;

a horizontal plate disposed within the inner casing, the plate having an upper edge and a lower edge;

a ferrule having an exterior area, an interior area, and a base edge, the ferrule interior area continuously disposed on the exterior surface of each of the right edge, the left edge, and the bottom edge of the outer casing;

a plurality of openings disposed from the lower area internal surface of the inner casing to the exterior area of the ferrule base edge;

a plurality of spikes attached to the plate lower edge, one of each of the plurality of spikes continuously disposed through one of each of the plurality of openings; and a plunger having a top half and a bottom half, each of the top half and the bottom half having a top portion and a bottom portion, the top half top portion disposed on the rod lower end, the bottom half bottom portion disposed on the plate upper edge, the bottom half disposed within the inner casing;

wherein the activation control has a depressed position and an alternate extended position;

wherein the activation control is in the depressed position when the activation control is fully disposed within the aperture;

wherein the activation control is in the extended position when the activation control top area is disposed above the aperture top side;

wherein the activation control slidingly engages the spring, the locking mechanism, the rod, the plunger, the plate, and the plurality of spikes;

wherein the plurality of spikes is configured to extend below the ferrule base edge when the activation control is in the depressed position;

wherein one of each of the plurality of spikes is configured to be fully disposed within one of each of the plurality of openings when the activation control is in the extended position.

2. The cane with extendable spikes of claim 1 wherein the ferrule is rubberized.

3. The cane with extendable spikes of claim 2 wherein the plurality of spikes is steel.

4. A cane with extendable spikes comprising:

a cane having a curved handle and a shaft, the shaft having a top end and a bottom end, the handle having a top surface, a bottom surface, a right side, and a left side;

a hollow inner casing medially disposed on the shaft bottom end, the inner casing having a right area, a left area, an upper area, and a lower area, each of the right area, the left area, the upper area, and the lower area having an external surface and an internal surface;

a U-shaped outer casing continuously disposed on each of the external surface of the left area, the right area, and the lower area of the inner casing, the outer casing having a right edge, a left edge, and a bottom edge, each of the right edge, the left edge, and the bottom edge having an exterior surface;

an aperture continuously disposed from the top surface of the handle proximal the left side to the upper area internal surface of the inner casing, the aperture having a top side and a bottom side;

an activation control disposed within the aperture top side, the activation control having a top area and a bottom area;

a rod having an upper end, a lower end, an external area, and an internal area, the rod continuously disposed within the aperture from the activation control bottom area to the shaft bottom end, wherein the activation control engages the rod;

a locking mechanism disposed on the activation control bottom area, the locking mechanism continuously disposed around the rod external area proximal the upper end, the locking mechanism having an upper surface and a lower surface;

an internal tension spring continuously disposed around the rod external area from the locking mechanism lower surface to the shaft top end;

a horizontal plate disposed within the inner casing, the plate having an upper edge and a lower edge;

a ferrule having an exterior area, an interior area, and a base edge, the ferrule interior area continuously disposed on the exterior surface of each of the right edge, the left edge, and the bottom edge of the outer casing;

wherein the ferrule is rubberized;

a plurality of openings disposed from the lower area internal surface of the inner casing to the exterior area of the ferrule base edge;

a plurality of spikes attached to the plate lower edge, one of each of the plurality of spikes continuously disposed through one of each of the plurality of openings;

wherein the plurality of spikes is steel; and a plunger having a top half and a bottom half, each of the top half and the bottom half having a top portion and a bottom portion, the top half top portion disposed on the rod lower end, the bottom half bottom portion disposed on the plate upper edge, the bottom half disposed within the inner casing;

wherein the activation control has a depressed position and an alternate extended position;

wherein the activation control is in the depressed position when the activation control is fully disposed within the aperture;

wherein the activation control is in the extended position when the activation control top area is disposed above the aperture top side;

wherein the activation control slidingly engages the spring, the locking mechanism, the rod, the plunger, the plate, and the plurality of spikes;

wherein the plurality of spikes is configured to extend below the ferrule base edge when the activation control is in the depressed position;

wherein one of each of the plurality of spikes is configured to be fully disposed within one of each of the plurality of openings when the activation control is in the extended position.

* * * * *